US005346285A

United States Patent [19]

West, III

[11] Patent Number: 5,346,285

[45] Date of Patent: Sep. 13, 1994

[54] STRUCTURALLY REINFORCED FURNITURE FRAMES

[76] Inventor: David T. West, III, 1925 Maple Wood Dr., Hagerstown, Md. 21740

[21] Appl. No.: 140,883

[22] Filed: Oct. 25, 1993

Related U.S. Application Data

[63] Continuation of Ser. No. 873,269, Apr. 24, 1992, abandoned.

[51] Int. Cl.[5] ..... A47C 7/16

[52] U.S. Cl. ..... 297/452.18; 297/452.1

[58] Field of Search ..... 297/452.1, 452.18, 440.15, 297/440.1, 440.22, 445, 446

[56] References Cited

U.S. PATENT DOCUMENTS

| | | | |
|---|---|---|---|
| 3,030,146 | 4/1962 | Faxon | 297/422 |
| 3,084,897 | 4/1963 | Kam Wah | 297/445 X |
| 3,674,311 | 7/1972 | Miller | 297/445 X |
| 3,822,079 | 7/1974 | Probber | 297/445 |
| 4,136,410 | 1/1979 | Vandenbark et al. | 297/452 X |
| 4,165,902 | 8/1979 | Ehrlich | 297/440 |
| 4,209,198 | 6/1980 | Apple, Sr. | 297/443 |
| 4,289,304 | 9/1981 | Muzzell | 297/452 X |
| 4,305,616 | 12/1981 | Martinez | 297/440.15 |
| 4,711,495 | 12/1987 | Magder | 297/440 |
| 4,755,000 | 7/1988 | Chiaro et al. | 297/440 |
| 4,815,789 | 3/1989 | Marcus | 297/440 |
| 4,867,507 | 9/1989 | Arai | 297/452 X |

*Primary Examiner*—Kenneth J. Dorner
*Assistant Examiner*—Milton Nelson, Jr.
*Attorney, Agent, or Firm*—Dowell & Dowell

[57] ABSTRACT

Furniture frames for sofas, chairs and related seating having wooden frames structurally reinforced by metallic frames which are anchored at each of the stress bearing components of the wooden frames and which metallic frames also permanently anchor the spring seat cushion suspension decking of the furniture.

12 Claims, 1 Drawing Sheet

STRUCTURALLY REINFORCED FURNITURE FRAMES

This application is a continuation of application Ser. No. 07/873,269, filed Apr. 24, 1992, and now abandoned.

BACKGROUND OF THE INVENTION

FIELD OF THE INVENTION

This invention is generally related to furniture such as sofas, chairs, love seats and related seating having seat cushions carried by a spring suspension decking and, more specifically, to such furniture wherein the upholstery frame, generally manufactured of wood, is reinforced at each of the stress points of the individual components of the furniture by being directly secured to a steel or other metallic frame mounted inwardly of the wooden frame. The steel reinforcing frames of the present invention are further designed to support the spring seat suspension decking which is comprised of a plurality of longitudinally extending steel spring elements which are secured to the metallic frame in such a manner as to prevent their release and in such a manner as to prevent metal to metal contact between the springs and the metallic frame. The invention may be utilized with seating incorporating arm and backrests, or in the alternative, in seating-incorporating only arms or backrests depending upon the exact configuration of the upholstery frame.

HISTORY OF THE RELATED ART

The use of steel spring frames in combination with various types of wooden furniture frames has been known, especially in the construction of bedding. Many beds are designed with an exterior wooden frame having inner rails which support a steel mattress frame having springs connected to steel elements extending along the periphery of the frame. However, such frames do not provide any reinforcement for the wooden frames to prevent failure of the wooden frame components, especially at areas where a great deal of stress is conveyed to the wooden frames. In bed frames, most stresses are vertically directed to the legs of the furniture, with little, if any, stress generated to the side elements of the wooden frames.

In the construction of conventional sofas, chairs and related seating type furniture which incorporate wooden upholstery frames often having arm and backrest portions which extend upwardly from the main seating deck, the joints between such components and the seating deck form points of failure after repeated usage due to stresses applied thereto.

Conventional upholstered furniture of the seating type often included helical springs for supporting the seat cushions relative to the cushion decking or base of the furniture. Such springs often failed over a period of time causing them to either yield allowing cushions to be unsupported at areas or to break free of their restraints allowing the springs to elevate vertically causing penetration of the springs into the upholstered cushions. In order to avoid the problems inherent in coiled steel springs, some manufacturers began utilizing high tension longitudinally extending springs which extend generally parallel with the bottom of the seat cushions. In early furniture construction such steel frames were anchored directly to the wooden furniture frames. However, the strength of such longitudinal steel springs frequently caused distortion or bending of the wooden frames after prolonged periods of use.

To avoid the bending of wooden frames by the use of longitudinally extending high stress steel springs in seating units, some manufacturers began to anchor the longitudinal steel springs in metallic frames to which upholstery or cushions would be directly attached. One such example of this type of furniture construction is disclosed in U.S. Pat. No. 4,711,495 to Magder. Unfortunately, with this type of construction, the benefit in appearance of the wooden upholstery frame is lost as the fabric is attached directly to steel elements. Such fabric attachment is not aesthetic and does not provide for a prolonged period of use of the fabric or cushioning material.

Other types of furniture have incorporated combinations of steel frames for supporting the spring elements together with wooden elements. U.S. Pat. No. 4,815,789 discloses a chair having a generally wooden outer frame which supports a steel inner frame that is seated above the wooden upholstery seating deck and is selectively secured thereto to prevent its shifting. The wooden elements are thereafter secured to one another or, in some instances, the wooden elements may be secured to frame members formed of metal. Unfortunately, the structures do not provide for reinforcement of the wooden frames by securing the metallic frames at points or areas where stress is anticipated in the furniture.

Additional examples of prior art are disclosed in U.S. Pat. Nos. 3,030,146 to Faxon, 3,822,079 to Probber, 4,209,198 to Apple, and 4,755,000 to Chiaro et al.

SUMMARY OF THE INVENTION

This invention is directed to structurally reinforced furniture and especially to upholstered seating units which may include either side, arm or back portions and which have an outer upholstery supporting wooden frame having a seating deck portion to which the arm and/or back support components are selectively secured and wherein a metallic reinforcing frame having a plurality of longitudinally extending springs mounted thereto is secured at each of the corner and other primary vertically extending posts of the arms and/or back portions of the chair. The metallic frame is mechanically secured so as to provide reinforcement at each stress bearing joint of the wooden frame. In the preferred embodiment, bearing plates are secured between the metallic frame and the wooden frame to further distribute loads between the steel and wooden frames and to distribute stress at the point of attachment of the steel frame to the wooden frames.

In the preferred embodiment of the present invention, the steel reinforcing frame is manufactured of square tubular steel having spaced clips secured to the upper surface thereof. Plastic inserts are placed in the clips so that when the ends of the longitudinal springs are secured thereto, metal to metal contact between the springs and the frame is effectively prevented thereby prolonging the life of the steel spring elements and preventing noise at the point of connection between the springs and the steel frame.

It is a primary object of the present invention to provide a steel reinforcing frame for use with wooden upholstered furniture of the seating type including sofas, love seats, chairs and the like wherein the outer wooden frames are reinforced at each of the points of stress between the seating deck of the wooden frame and the vertical components for the arm and/or back portions of the furniture.

It is also an object of the present invention to provide metallic reinforced upholstered furniture wherein the spring elements upon which seating cushions are supported are permanently anchored to metallic frames so that all stress from the springs is directed to the steel frames and not to surrounding wooden upholstery frames.

DESCRIPTION OF THE PREFERRED EMBODIMENT

Figure 1:
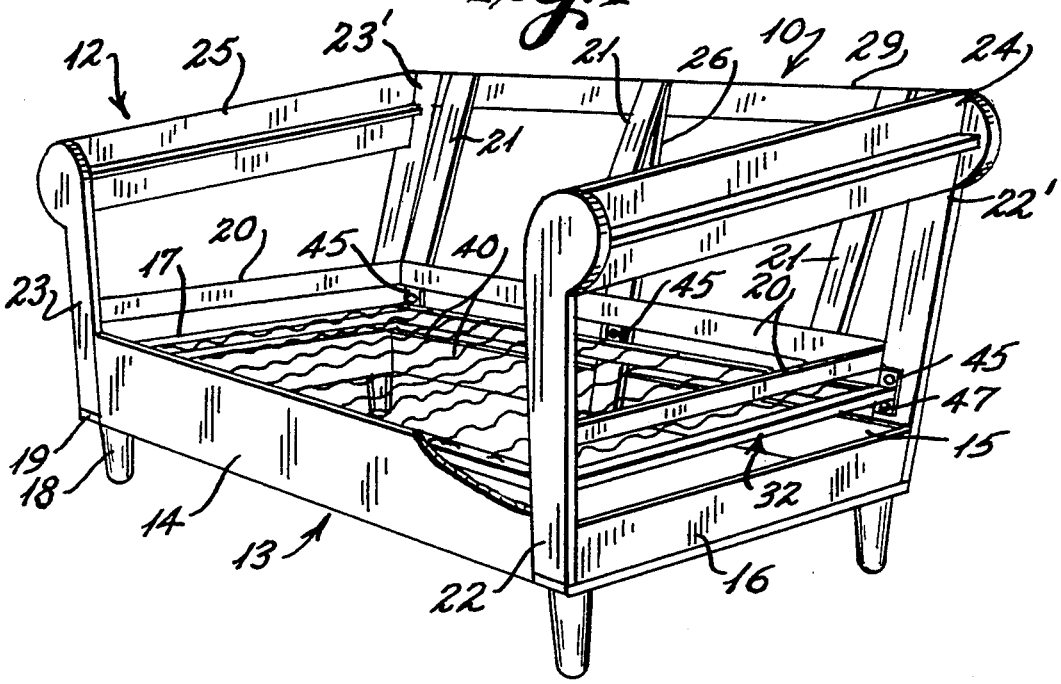
FIG. 1 is a front perspective view of an article of furniture incorporating an outer wooden upholstery supporting frame and the inner metallic reinforcing frame of the present invention showing the reinforcing frame being secured at the points of stress of the arm and back portions of the furniture.

With continued reference to the drawings, an article of furniture such as a sofa or love seat 10 is disclosed having a primary wooden frame or upholstery supporting frame 12 which includes a base wooden seating deck 13 having front, rear and side components 14, 15, 16 and 17, respectively. Each of the components of the base seating deck are secured at their ends by suitable fasteners and/or gluing and provide a rectilinear frame to which fabric and various upholstery cushioning may be secured. The base wooden deck is supported by a plurality of legs 18 which are screwed or otherwise secured into base rails 19 provided at each end of the frame.

In the specific embodiment shown, the wooden frame also includes side and rear cushion restraint members 20 and 21 which are connected to the side or armrest frame elements or components and backrest frame which are both joined to the base deck 13. The armrest components include front and rear corner posts 22, 22', and 23, 23' which are joined to the wooden base deck by conventional fasteners and/or glue and which are joined by horizontally oriented armrest elements 24 and 25 which extend between the upper ends thereof. It should be noted that the upper ends of each of the posts and the elements 24 and 25 are suitably configured so as to form rounded supports for the upholstery so as to provide shaping for the finished article of furniture.

The back frame includes at least one vertically oriented post 26 which is horizontally connected to an upper slat 29 and to the rear component 15 of the base frame 13 by conventional fasteners and/or gluing.

Figure 3:
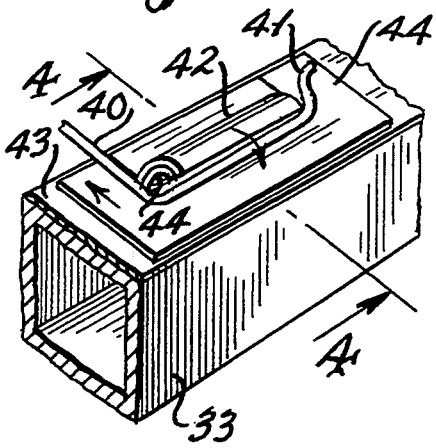
FIG. 3 is an enlarged cross-sectional perspective view showing the connector strips for supporting the ends of the springs secured to the reinforcing frame.
Figure 4:
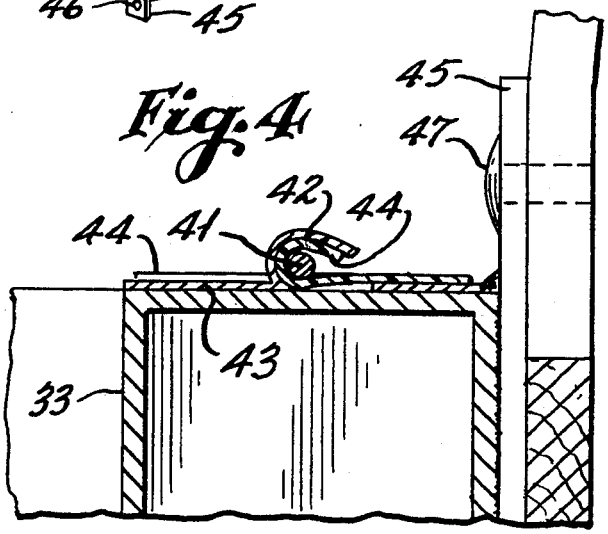
FIG. 4 is an enlarged cross-sectional view taken along lines 4—4 of FIG. 3 showing a spring seated in an insert cushion of the connector strips.

To reinforce each of the wooden armrest and backrest frame portions relative to the wooden seating deck, the present invention incorporates a tubular steel frame 32 having front 33, rear 34 and side elements 35 and 36 which are welded to form a unitary rectangular structure. The reinforcing frame not only reinforces the wooden components at areas which stress will be imparted to the wooden arm and backrest elements, but also provides a rigid frame for supporting the spring decking upon which furniture cushions will be supported. In this respect, a plurality of longitudinal springs 40 are provided having curved end portions 41 which are designed to be uniquely secured to the upper portion of the metallic frame by way of a plurality of elongated hooks 42 which are welded or otherwise secured to the upper surface of the frame. In practice, longitudinal strips 43 of thin gauge metallic material are punched to provide spaced 1" protrusions or hooks as is shown in FIGS. 3 and 4. The thin gauge steel is directly welded to the front and rear tubular sections 33 and 34 of the reinforcing frame. In order to prevent metal to metal contact between the springs 40, the hooks 42 and the tubular sections (including the strips 43), lubricated nylon inserts 44 are inserted within each of the hooks and over the strips 43 adjacent each hook and are retained within the generally C-shaped configuration of each hook. Once the nylon inserts have been inserted inwardly of each of the retaining hooks, the ends 41 of the springs are inserted therein thereby locking the springs in place with the nylon inserts situated between the metal contact surfaces. The spring mounting structure not only prevents metal to metal contact and thereby reduces wear between metal components, but also prevents the generation of sound by avoiding metal to metal contact.

The reinforcing frame may also include a plurality of mounting plates or brackets which are secured thereto at points at which the frame will be secured to the wooden outer or upholstery frame 12. The plates are designated at 45 in drawing FIGS. 1 and 2.

Figure 2:
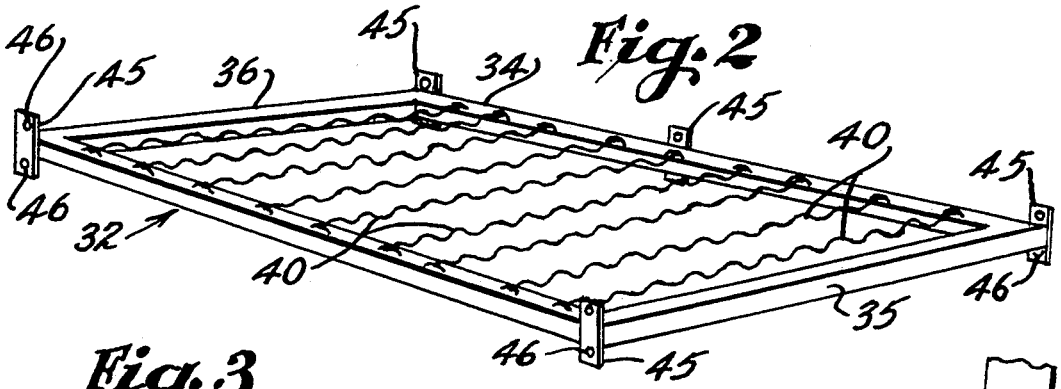
FIG. 2 is a perspective view of the metallic reinforcing frame and spring suspension deck elements of the present invention.

The reinforcing frame 32 is inserted inwardly of the outer wooden frame as is shown in FIG. 1 until the brackets 45 are seated flush against the vertical components of the arm and backrest portions of the wooden frame. At this point the frame should be levelled to insure that it provides a level suspension deck for supporting the upholstered cushions which will be associated with the furniture. Thereafter, suitable fastening elements such as bolts are extended through the vertical posts 22, 22" and 23, 23" and each of the vertical post 26, thereby permanently fixing the reinforcing frame to the wooden frame at a point spaced just above the wooden suspension deck. In this manner, each of the vertically extending elements is reinforced adjacent the lowermost end thereof and thereby are rigidly united with respect to one another in such a manner that each stress bearing component along the side and back portions of the furniture are adequately reinforced. Further, as spaced openings 46 are provided in each of the mounting plates, separately spaced fasteners 47 may be utilized to connect the reinforcing frame to the wooden frame stress bearing components thus distributing any stress to spaced points along the length of the vertical posts.

In view of the reinforced construction of the present invention, it is possible to do away with additional wooden framing which is not only heavy but subject to swelling and/or shrinkage due to environmental conditions. By eliminating additional wooden substructure, while allowing sufficient wooden exterior structure to be utilized to support upholstery and fabric coverings, a lightweight and yet extremely durable article of furniture is provided having a life which far exceeds that of conventional wooden reinforced seating elements.

Although the preferred embodiment of the present invention has been described utilizing a tubular steel reinforcing frame, it is possible that other materials or other configurations may be utilized. However, the tubular structure of steel frame offers a preferred structural rigidity not available in some other configurations. In addition to the foregoing, it is possible that the steel tubing may be directly bolted to the wooden frame components of the arm and backrest of the furniture without using the mounting plates associated with the preferred embodiment. The disadvantage of not utilizing the mounting plates is that the bolts extending through the reinforcing frame and the wooden frame would be more closely spaced with respect to one another thereby directing stress to a more concentrated section of the wooden framing.

I claim:

1. An article of furniture utilized for seating comprising, a rectilinear horizontally oriented wood frame deck having front, rear and opposite side components, vertically extending wooden arm rest support posts connected to said frame deck adjacent each side component thereof, at least one vertically extending wooden back rest support post fastened to said rear component of said frame deck, each of said arm rest support posts and said at least one back rest support post having inner and outer surfaces, a rectilinear horizontally oriented metallic reinforcing frame having front, rear and opposite side portions, and fastening means for securing said reinforcing frame directly to said inner surfaces of each of said arm rest support posts and said at least one back rest support post adjacent said wooden frame deck so as to reinforce said support posts.

2. The article of furniture of claim 1 including at least two wooden arm rest support posts connected to said frame deck adjacent each of said side components thereof and adjacent said front and rear components.

3. The article of furniture of claim 1 in which said reinforcing frame includes four corners, mounting plates secured to said reinforcing frame adjacent each of said corners, each of said mounting plates having at least two vertically spaced openings therein, and one of said fastening means extending through each of said openings.

4. The article of furniture of claim 3 including at least one mounting plate secured to said rear portion of said reinforcing frame and spaced from said corners.

5. The article of furniture of claim 1, including a plurality of longitudinally extending spring means, and means for mounting said spring means to said front and rear portions of said metallic reinforcing frame.

6. The article of furniture of claim 2, including a plurality of elongated hook elements being secured to said front and rear portions of said metallic reinforcing frame and extending upwardly therefrom, a non-metallic insert being disposed within each of said hook elements, each of said longitudinally extending spring means having outer end portions, and said outer end portions being seated within said non-metallic inserts such that said spring means are mounted to said hook elements in a non-metallic contact relationship with respect to one another.

7. An article of furniture comprising a frame deck having front, rear and side components; an arm rest support post connected to said frame deck adjacent each said side component; a back rest support post connected to said rear component of said frame deck, said arm rest support posts and said back rest support post having inner and outer surfaces; a metallic reinforcing frame having front, rear and side portions; fastening means for securing said reinforcing frame to said inner surfaces of said arm rest support posts and said back rest support post adjacent to said frame deck so as to reinforce said support posts; a plurality of elongated hook elements secured to opposite portions of said reinforcing frame and extending outwardly therefrom; a non-metallic insert disposed within each of said hook elements; and a plurality of resilient metallic elements extending between said opposite portions of said reinforcing frame and having end portions seated within said non-metallic inserts.

8. The article of furniture of claim 7, wherein said back rest support post is fastened directly to said rear component of said frame deck, and said reinforcing frame is fastened directly to said inner surfaces of said arm rest support posts and said back rest support post.

9. The article of furniture of claim 7, comprising two arm rest support posts connected to said frame deck adjacent to each of said side components and said front and rear components.

10. The article of furniture of claim 7, wherein said metallic resilient elements are springs.

11. The article of furniture of claim 7, wherein said reinforcing frame includes four corners; mounting plates secured to said reinforcing frame adjacent each of said corners, each of said mounting plates defining vertically spaced openings therein, and one of said fastening means extends through each of said openings.

12. The article of furniture of claim 11, comprising a mounting plate secured to said rear portion of said reinforcing frame and spaced from said corners.

* * * * *